US007904979B2

(12) United States Patent
Walke et al.

(10) Patent No.: US 7,904,979 B2
(45) Date of Patent: Mar. 15, 2011

(54) MATTRESS WITH PATIENT TRANSPORT APPARATUS INCORPORATED THEREIN

(75) Inventors: James L. Walke, Batesville, IN (US); Steven A. Dixon, Cincinnati, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 653 days.

(21) Appl. No.: 11/671,188

(22) Filed: Feb. 5, 2007

(65) Prior Publication Data

US 2007/0180625 A1 Aug. 9, 2007

Related U.S. Application Data

(60) Provisional application No. 60/765,562, filed on Feb. 6, 2006.

(51) Int. Cl.
*A61G 7/10* (2006.01)

(52) U.S. Cl. ..... 5/706; 5/628; 5/625; 5/81.1 R

(58) Field of Classification Search ..... 5/625–628, 5/706, 81.1 R, 81.1 T
See application file for complete search history.

(56) References Cited

U.S. PATENT DOCUMENTS

| | | | | |
|---|---|---|---|---|
| 4,274,168 | A | 6/1981 | Depowski | |
| 4,301,791 | A * | 11/1981 | Franco, III | 602/19 |
| 5,018,226 | A * | 5/1991 | Davies et al. | 5/81.1 R |
| 5,023,967 | A | 6/1991 | Ferrand | |
| 5,138,729 | A | 8/1992 | Ferrand | |
| 5,150,487 | A | 9/1992 | Hemphill | |
| 5,189,746 | A | 3/1993 | Horie | |
| 5,249,321 | A * | 10/1993 | Graf | 5/494 |
| 5,279,010 | A | 1/1994 | Ferrand et al. | |
| 5,323,500 | A | 6/1994 | Roe et al. | |
| 5,345,629 | A | 9/1994 | Ferrand | |
| 5,400,450 | A | 3/1995 | Leoutsakos | |
| 5,492,285 | A | 2/1996 | Hamrick | |
| 5,742,958 | A | 4/1998 | Solazzo | |
| 5,802,640 | A | 9/1998 | Ferrand et al. | |
| 5,906,016 | A | 5/1999 | Ferrand et al. | |
| 5,906,017 | A | 5/1999 | Ferrand et al. | |
| 5,996,150 | A | 12/1999 | Blevins et al. | |
| 6,055,988 | A | 5/2000 | Perisho | |
| 6,073,291 | A * | 6/2000 | Davis | 5/711 |
| 6,128,796 | A | 10/2000 | McCormick et al. | |
| 6,427,270 | B1 | 8/2002 | Blevins et al. | |
| 6,438,776 | B2 | 8/2002 | Ferrand et al. | |

(Continued)

FOREIGN PATENT DOCUMENTS

EP 0 301 614 A1 2/1989

(Continued)

OTHER PUBLICATIONS

Evacusled™, General Questions and Answers, http://www.evacusled.com/print-FAQ.htm, last visited Jan. 29, 2007. Date of original publication unknown.

(Continued)

*Primary Examiner* — Fredrick Conley
(74) *Attorney, Agent, or Firm* — Barnes & Thornburg LLP

(57) ABSTRACT

A mattress having a storage compartment is provided. The storage compartment is used to hold items that are useful in the transport of a patient located on the mattress, such as a patient restraint that can be used to secure the patient to the mattress during transport.

25 Claims, 8 Drawing Sheets

U.S. PATENT DOCUMENTS

| | | | |
|---|---|---|---|
| 6,536,056 | B1 | 3/2003 | Vrzalik et al. |
| 6,668,408 | B2 | 12/2003 | Ferrand et al. |
| 6,691,349 | B2 | 2/2004 | Blevins |
| 6,904,631 | B2 | 6/2005 | Vrzalik et al. |
| 6,941,598 | B2 | 9/2005 | Ferrand et al. |
| 7,007,330 | B2 | 3/2006 | Kuiper et al. |
| 7,055,190 | B2 | 6/2006 | Barth et al. |
| 7,114,204 | B2 | 10/2006 | Patrick |
| 7,210,176 | B2 | 5/2007 | Weedling et al. |
| 7,243,382 | B2 | 7/2007 | Weedling et al. |
| 7,266,852 | B2 | 9/2007 | Davis |
| 7,340,785 | B2 | 3/2008 | Weedling et al. |
| 7,346,945 | B2 | 3/2008 | Phillips et al. |
| 7,415,738 | B2 | 8/2008 | Weedling et al. |
| 7,540,044 | B2 | 6/2009 | Patterson et al. |
| 2005/0246833 | A1* | 11/2005 | Barth et al. ..... 5/81.1 R |
| 2006/0213010 | A1 | 9/2006 | Davis |
| 2006/0253976 | A1 | 11/2006 | Weedling et al. |

FOREIGN PATENT DOCUMENTS

| | | |
|---|---|---|
| FR | 2 782 915 | 3/2000 |
| GB | 2 411 362 A | 8/2005 |
| WO | WO 86/07253 | 12/1986 |
| WO | WO 92/03115 | 3/1992 |
| WO | WO 01/37774 A1 | 5/2001 |

OTHER PUBLICATIONS

International Search Report for Application No. PCT/US2007/061606, Jun. 6, 2007, 11 pgs.

* cited by examiner

MATTRESS WITH PATIENT TRANSPORT APPARATUS INCORPORATED THEREIN

RELATED APPLICATIONS

This application claims the benefit of U.S. Provisional Patent Application Ser. No. 60/765,562, filed Feb. 6, 2006, which is incorporated herein by reference.

BACKGROUND

The present invention relates to mattresses and, more specifically, to apparatus that facilitate the transport or evacuation of a person on a mattress particularly when the mattress must be separated or removed from the bed frame that normally supports it.

Many facilities, such as healthcare and long-term care facilities, have a significant number of non-ambulatory patients or residents. Such individuals often spend a significant amount of time positioned on a mattress supported on a bed frame. Transport of non-ambulatory individuals can be problematic, particularly when it is not possible to use a wheeled bed frame, stretcher, or wheelchair to transport such individuals. Such may occur, for example in emergency situations in which elevators may not be available to transport the wheeled bed frames or conditions otherwise impede the mobility of the bed frame. Such situations may include for example, a weather-related emergency (such as a tornado or hurricane warning), natural disaster, or other emergency requiring the rapid evacuation of people from an area or a facility. An apparatus that assists in the transport of a person located on a mattress would be beneficial particularly in such events.

SUMMARY

One embodiment of the present invention provides a patient support. The patient support includes a cover defining an interior region. The interior region includes at least one support member adapted to support a patient, and a receptacle located in the interior region. The receptacle is sized to store a patient restraint when the patient restraint is not in use.

The patient support may further include a patient restraint deployable to secure a patient to the patient support. The patient support may include a handle coupled to the cover. The support member may include at least one air bladder adaptable to be used as a flotation device. The support member may include a bendable section disposed at a location to facilitate transport. The patient support may include a slide member coupled to the bendable section.

Another embodiment of the present invention provides a mattress for use with a patient. The mattress includes a mattress structure having a lower surface and a support surface disposed opposite the lower surface, the support surface defining an outer perimeter; at least one storage compartment defined by the mattress structure; and a patient restraint disposable within the at least one storage compartment when not in use and engageable with the patient and the mattress structure to secure the patient to the mattress structure when deployed.

The at least one storage compartment may be disposed within a volume bounded by the lower surface, the support surface, and a set of planes intersecting the outer perimeter and oriented substantially transverse to the support surface. The mattress may include a grip member affixed to the mattress structure, whereby the mattress structure can be grasped and used to move a patient secured thereto. The mattress may include at least one seat stiffener situated near the longitudinal midpoint of the mattress structure. The mattress may include at least one grip member affixed to the mattress structure adjacent to the at least one seat stiffener. The patient restraint may include a first member securable to a second member. The second member may be affixed to the lower surface of the mattress structure. The mattress may include at least one slide member engageable with a floor when the patient restraint is deployed to facilitate sliding of the mattress structure. The at least one slide member may be comprised of a material with a low coefficient of friction, and at least one slide member may be comprised of a material with a high coefficient of friction. At least one slide member may be comprised of a material with a high coefficient of friction and may be placed nearer the outer perimeter of the support surface than the at least one slide member comprised of a material with a low coefficient of friction. The patient restraint may comprise a fabric wrap, the patient being securable between the fabric wrap and the support surface. The fabric wrap may comprise a disengageable latching mechanism for securing the fabric wrap in a deployed position wherein the patient is secured between the fabric wrap and the support surface. The disengageable latching mechanism may be disengageably securable to a second latching mechanism affixed to the lower surface of the mattress structure. The fabric wrap may include an adjustable strap which is tightenable to secure the patient to the mattress structure. The at least one storage compartment may include a first storage compartment at a head end of the mattress structure and a second storage compartment at a foot end of the mattress structure. The patient restraint may be affixed to the mattress structure, the patient restraint and the grip member each being disposable in the at least one storage compartment. The mattress may include a second patient restraint and a second grip member, the patient restraint and grip member being disposable in the first storage compartment and the second patient restraint and second grip member being disposable in the second storage compartment. The mattress may include a foam structure, the at least one storage compartment being at least partially defined by the foam structure. The mattress may include at least one fluid filled bladder disposed within the mattress; and a pressure regulating apparatus operably coupled to said bladder. The mattress may include at least two articulating longitudinal sections.

Yet another embodiment of the present invention provides a mattress for use with a person. The mattress includes a mattress structure having a lower surface and a support surface disposed opposite the lower surface, the support surface adapted to support a person, the support surface having a head end and a foot end spaced apart from the head end, the mattress structure including a foam member and at least one fluid filled bladder, the mattress structure defining a first volume bounded by the lower surface, the support surface and the head and foot ends; at least one storage compartment disposed within the first volume; at least one patient restraint affixed to the mattress structure and disposable in the at least one storage compartment when not in use and engageable with the patient and the mattress to secure the patient to the mattress when deployed; and a grip member affixed to the mattress, the grip member being graspable by an individual when relocating the mattress with the patient secured thereto by the patient restraint.

Additional features of the present invention will become apparent to those skilled in the art upon consideration of the following detailed description.

BRIEF DESCRIPTION OF THE DRAWINGS

The above mentioned and other features of the present invention, and the manner of attaining them, will become more apparent and the present invention itself will be better understood by reference to the following description of an exemplary embodiment of the present invention taken in conjunction with the accompanying drawings, wherein.

The embodiments disclosed herein are not intended to be exhaustive or to be construed as limiting the scope of the present invention to the precise form disclosed.

DETAILED DESCRIPTION

A mattress structure 20 which is adapted to assist in the evacuation of a patient 22 located on the mattress is depicted in FIGS. 1-5. Mattress structure 20 includes an upper support surface 24 on which a person such as patient 22 can rest. Mattress 20 also includes a lower surface 26 which can be placed in engagement with a supporting bed frame (not shown). The supporting bed frame may be a hospital bed frame. The hospital bed frame may include one or more articulatable deck sections. Such deck sections may be articulatable to position a patient in a horizontal position or a "chair" position.

Figure 1:
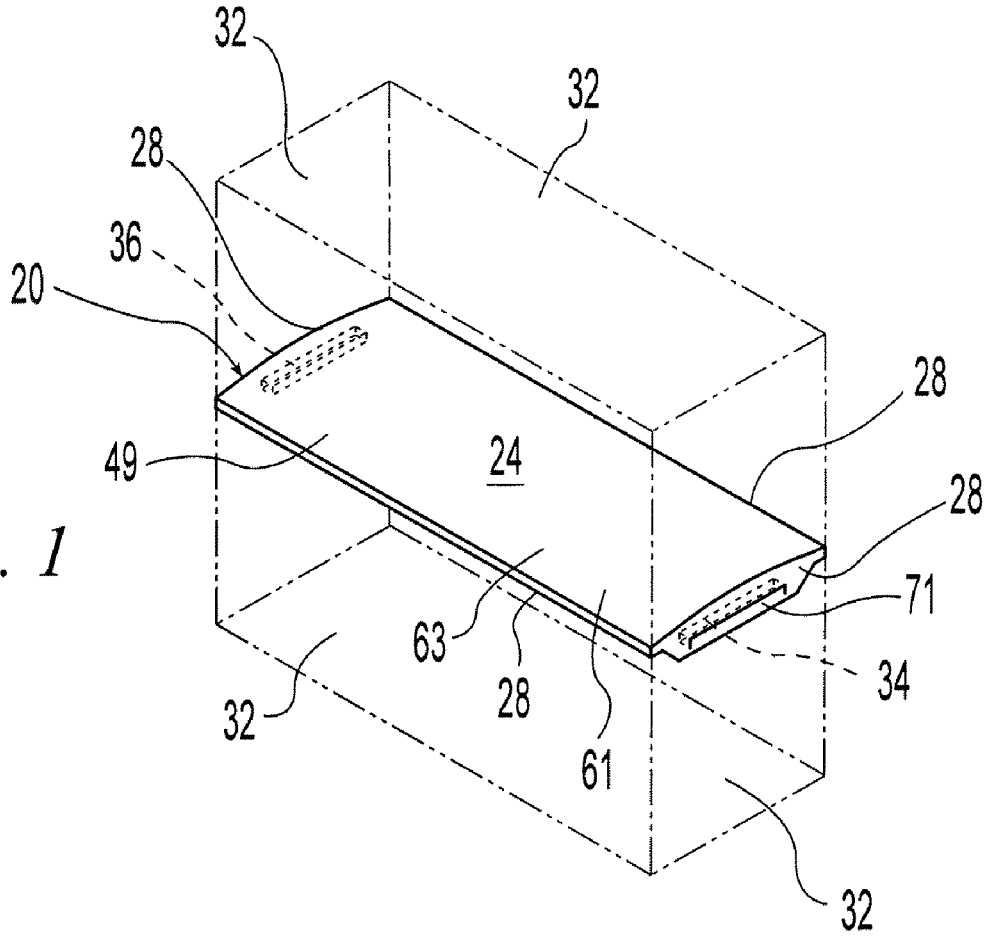
FIG. 1 is a perspective view of a mattress including a storage compartment for a patient restraint.

As seen in FIG. 1, upper surface 24 defines a generally rectilinear outer perimeter 28. A volume is bounded by said support surface 24, said lower surface 26 and planes 32 intersecting said outer perimeter 28 and oriented substantially transverse to said upper surface 24. Pockets or storage compartments 34, 36 are located within the volume and are used to store patient restraints 38, 40 and handles or grip members 42, 44. As discussed in greater detail below restraints 38, 40 are used to secure patient 22 to mattress 20 and grip members 42, 44 facilitate the movement of mattress 20 with patient 22 secured thereto during an evacuation event. Storage compartments 34, 36 are located at the foot end and head end of mattress 20 respectively.

Figure 5A:
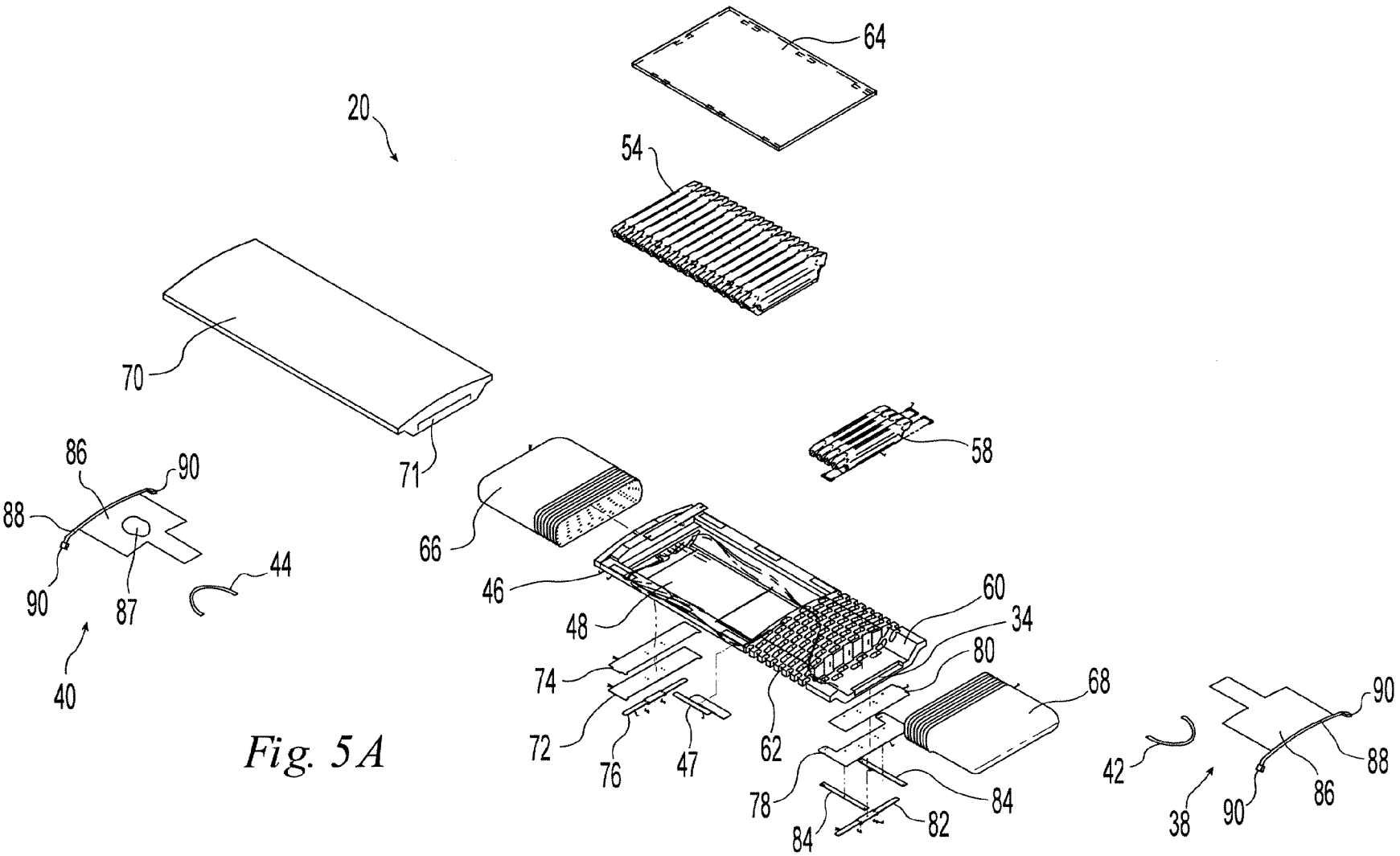
FIG. 5*a* is an exploded perspective view of an exemplary mattress in accordance with the present invention.
Figure 5B:
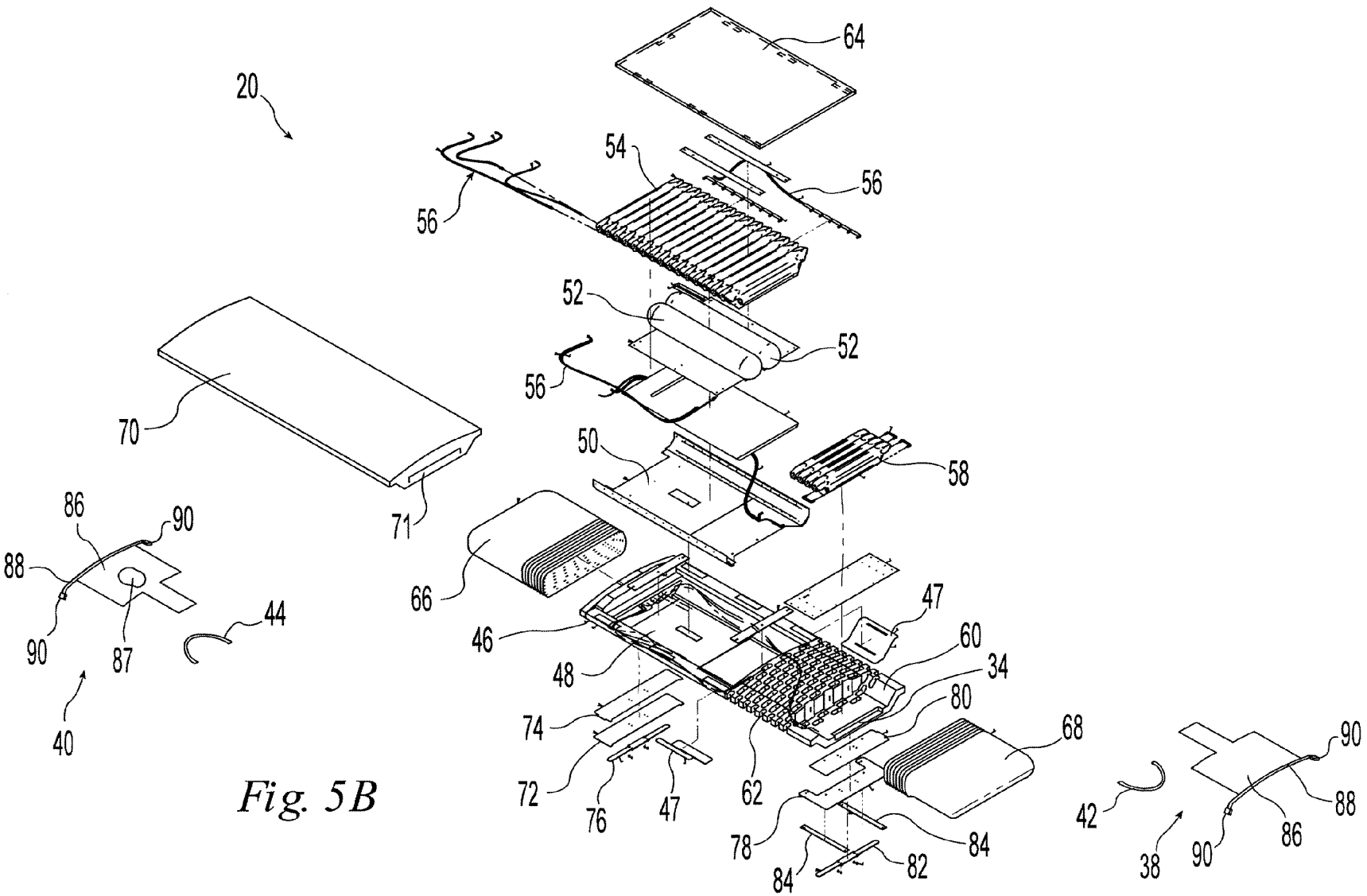
FIG. 5*b* is an exploded perspective view of another exemplary mattress in accordance with the present invention.

The general construction of mattress structure 20 is best understood with reference to the exploded views of FIGS. 5*a* and 5*b*, which illustrate exemplary mattress structures suitable for use in connection with the present invention. Except for storage compartments 34, 36, patient restraints 38, 40 and grip members 42, 44, mattress structure 20 is made of conventional materials and components similar to mattress structures commercially available from Hill-Rom Company, Inc. having a place of business in Batesville, Ind. Mattress structure 20 may include all of the components shown in FIG. 5*b*, or may not include all of such components, as shown in FIG. 5*a*.

In the illustrated embodiment, mattress structure 20 includes a foam portion or bucket 46 formed out of open cell urethane foam. Foam bucket 46 has a large recess 48 for receiving rigid substrate 50 which functions as a mounting assembly.

As shown in FIG. 5*b*, turning bladders 52 are positioned above substrate 50. Bladders 52 are deflated during normal usage of mattress 20. Inflating one of bladders 52 is useful when a caregiver must turnover patient 22. Located above turning bladders 52 are upper torso bladders 54. Bladders 54 are inflated with a fluid and are useful in spreading the weight of patient 22 over a larger support area and thereby inhibiting the formation of decubitus ulcers on patient 22. Pressure regulating apparatus 56 including fluid conduits and sensors are coupled with bladders 52, 54 to regulate the fluid pressure within bladders 52, 54. Pressure regulating apparatus 56 is also coupled to foot bladders 58. External equipment (not shown) is coupled with apparatus 56 to introduce and regulate either gaseous or liquid fluids within bladders 52, 54, 58. One or more of bladders 52, 54, 58 and/or additional bladders, such as perimeter bladders (not shown) may be configured to be inflated to provide a flotation device. Such additional perimeter bladders may be stored within the mattress structure 20 when not inflated. As such, the bladders may be used to support a patient during transport over water.

In the exemplary mattress structure 20 of FIGS. 5*a* and 5*b*, foot bladders 58 are located in a recess 60 at the foot end of mattress structure 20. Located between recesses 48 and 60 is a foam section 62. One or more foam sections 62 or other bendable sections facilitates the bending of mattress structure 20 when mattress 20 is placed on an articulating hospital bed frame. Such bendable sections 62 may also be disposed at particular locations in the mattress to facilitate transport of a patient on the mattress, or for other reasons.

Figure 6A:
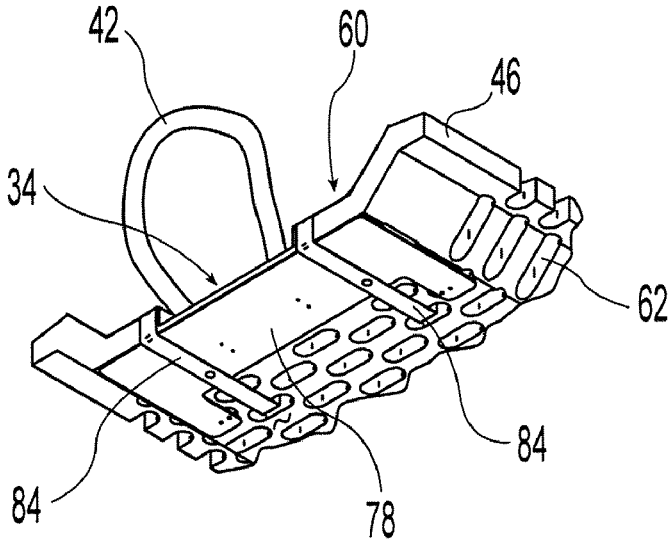
FIG. 6*a* is a perspective detail view showing a portion of an exemplary mattress assembly.
Figure 6B:
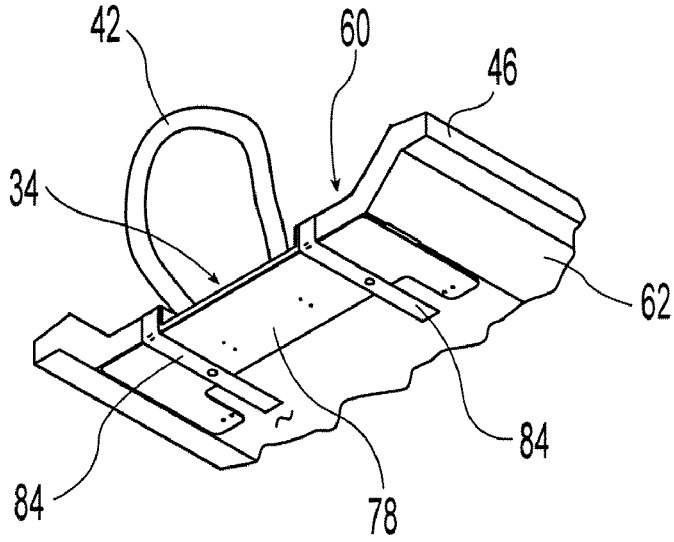
FIG. 6*b* is a perspective view showing a portion of another exemplary mattress assembly.

As shown in FIG. 6*a*, foam section 62 may include perforations to help facilitate adjustment of the length of the foot section. Hospital beds that are capable of assuming a chair position may have an adjustable length (i.e., expandable and/or retractable) foot section. FIG. 6*b* shows another embodiment wherein foam section 62 does not include perforations.

Seat stiffeners 47 are attached to the sides of foam bucket 46 near the longitudinal midpoint of mattress structure 20 to reinforce the area of mattress 20 which often supports the pelvic region of the patient. Alternative or additional handles or grips 43 and 45 may be located near seat stiffeners 47 as shown in FIG. 3*c*. Overlying bladders 54, perforated foam section 62 and bladders 58 is a foam overlay 64. A polyurethane film sheet 66 is wrapped about the foam bucket and overlaying support members to shield the foam structures and bladders from liquids and bodily fluids. A fire barrier fabric 68 is located outside film sheet 66 and a layer of ticking 70 provides the outermost layer of the mattress structure 20. In the exploded views of FIGS. 5*a* and 5*b*, ticking 70 is depicted off to the side and, in the final assembly, all of the other parts depicted in FIGS. 5*a* and 5*b* are located within ticking 70.

Further in the exemplary mattress structure 20 of FIGS. 5*a* and 5*b*, an upper torso anchor plate 72 is secured to the bottom side of foam bucket 46 with tape 74. An anchor strip 76, located exterior of ticking 70, is secured to anchor plate 72 with threaded fasteners. Similarly, at the foot end of mattress 20, a foot anchor plate 78 is secured to the bottom of foam bucket 46 with tape 80. Anchor strip 82, located exterior of ticking 70, is secured to anchor plate 78 with threaded fasteners. Attachment straps 84 are secured to anchor plate 78 and wrap around into recess 60 where foot bladders 58 are secured to straps 84.

Figure 2:
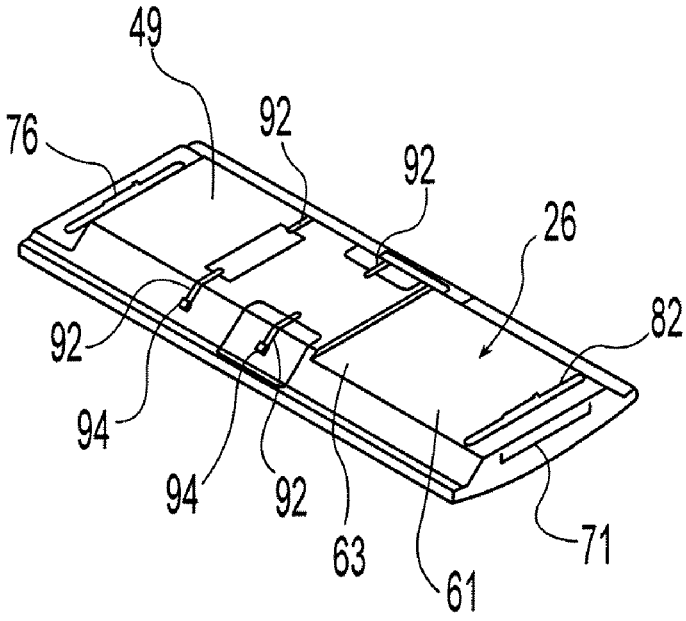
FIG. 2 is another perspective view showing the mattress of FIG. 1.

The lower surface 26 of mattress 20 is shown in FIG. 2. Anchor strips 76 and 82 function as frame securement members and are used to respectively secure the upper torso longitudinal section 49 and foot longitudinal section 61 of mattress 20 to an articulating bed frame in a manner known in the art. The upper torso section 49 and foot section 61 are separated by a longitudinal section 63 formed by perforated foam 62 or other bendable or compressible material. Securing the upper and lower longitudinal sections 49, 61 to the bed frame inhibits the displacement of mattress 20 on the bed frame due to the articulating movement of the supporting bed frame and mattress 20.

Storage compartments 34, 36 are formed by providing one or more pockets or recesses in the foot and head ends, respectively, of mattress 20. In the illustrated embodiment, storage compartments 34, 36 are formed by cutting generally rectilinear recesses into foam bucket 46. The recesses cut into foam bucket 46 to form storage compartments 34, 36 are lined with polyurethane film sheet 66 and fire barrier fabric 68. Although the foam bucket 46 does not form the actual surface of the storage compartments 34, 36 due to this double layered lining, the recesses cut into foam bucket 46 do define the shape of storage compartments 34, 36. A freely hanging flap 71 of ticking 70 is used to close the storage compartments 34, 36. Flaps 71 may be secured in a closed position by the use of interlocking hook and loop fastening strips such as Velcro® strips.

When not in use, patient restraint 38 and grip member 42 are positioned within storage compartment 34 at the foot end of mattress 20 and flap 71 is closed. Similarly, patient restraint 40 and grip member 44 are positioned within storage compartment 36 at the head end of mattress 20 and covered by a ticking flap 71 when not in use. Patient restraints 38, 40 each include a fabric wrap 86 that has a generally T-shaped outline. The stem base of the "T" of each of these wraps 86 is permanently secured to mattress 20 within storage compartments 34, 36.

Any suitable fabric material may be used to form wraps 86. The use of a stretchable fabric to form wraps 86 may be useful when attempting to secure odd shaped articles to mattress 20 together with patient 22 during transport, or, to assist in securing patient 22 to mattress 20. Suitable stretchable fabrics that can be used to form wraps 86 are fabrics formed of material manufactured with Lycra® brand spandex fibers which is commercially available from Invista, a subsidiary of Koch Industries, Inc. having a place of business in Wichita, Kans. Spandex fibers are elastic, segmented polyurethane fibers that can typically be stretched to more than about 500% of their original length without breaking. Fibers that are fire-resistant or fire-proof, or which may be treated for fire-resistance or fire-proofing are also included in the illustrated embodiment.

Grip members 42, 44 are generally U-shaped flat nylon cords or similar materials that are secured to mattress 20 at each of their ends within storage compartments 34, 36. Wraps 86 and members 42, 44 are affixed within storage compartments 34, 36 to anchor plates 72 and 78 respectively. Wraps 86 and members 42, 44 may be secured using threaded fasteners. Alternatively, rigid polymeric bosses may be secured to anchor plates 72 and 78 and project into storage compartments 34, 36 where wraps 86 and grip members 42, 44 can be secured to the polymeric bosses using any suitable fasteners, adhesives or other means.

In alternative embodiments, it may be desirable to form grip members 42, 44 from a single elongated loop of material instead of two U-shaped segments. This elongated loop would extend the full longitudinal length of mattress 20 and project outwardly from the ends to form grip members 42, 44. This single loop of material could be secured to mattress 20 at various locations along the longitudinal length of mattress 20. The loop of material could be secured either inside ticking 70 (and project out the opening formed in ticking 70 at storage compartments 34, 36) or on the exterior of ticking 70. The projecting ends forming grips 42, 44 would still be stored within compartments 34, 36 when not in use. The use of an elongated loop of material extending the full longitudinal length of mattress 20 could be beneficial particularly when mattress 20 is intended for use with bariatric patients.

Figure 3A:
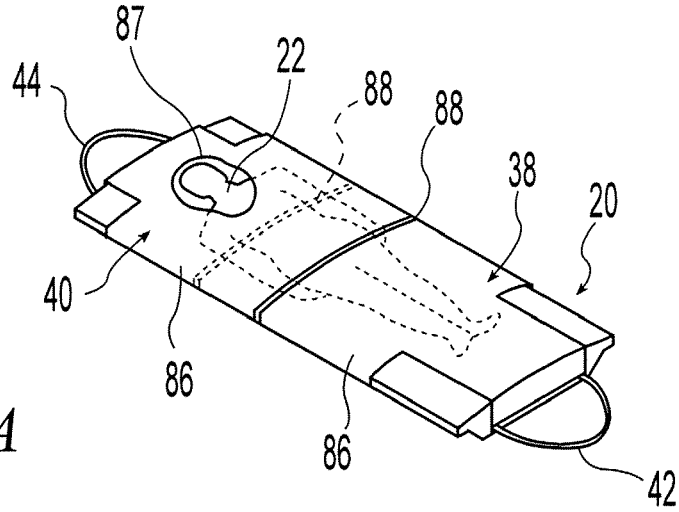
FIG. 3*a* is a perspective view of the mattress showing the patient restraint in a deployed position.
Figure 3B:
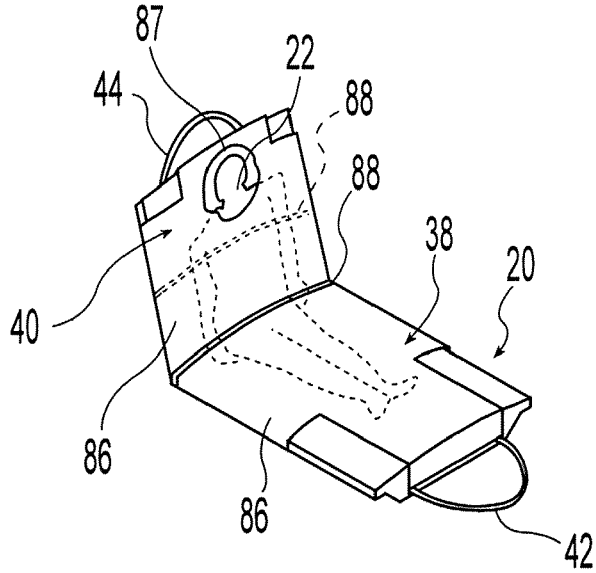
FIG. 3*b* is a perspective view of the mattress showing the upper torso longitudinal section in an upright position.
Figure 3C:
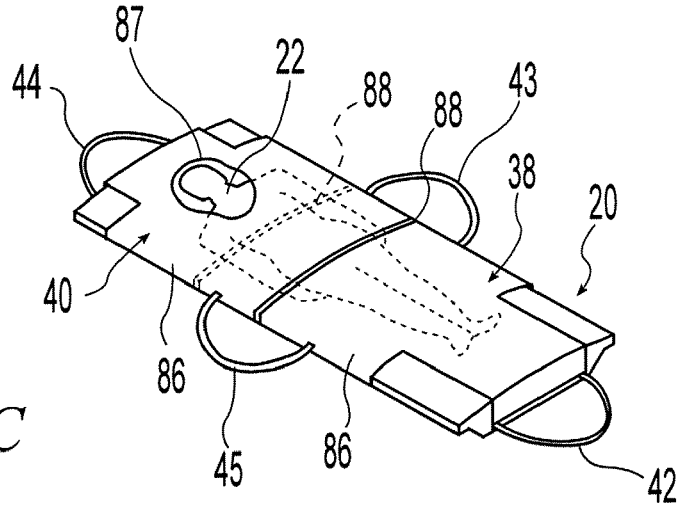
FIG. 3*c* is a perspective view of another embodiment of the mattress.
Figure 4:
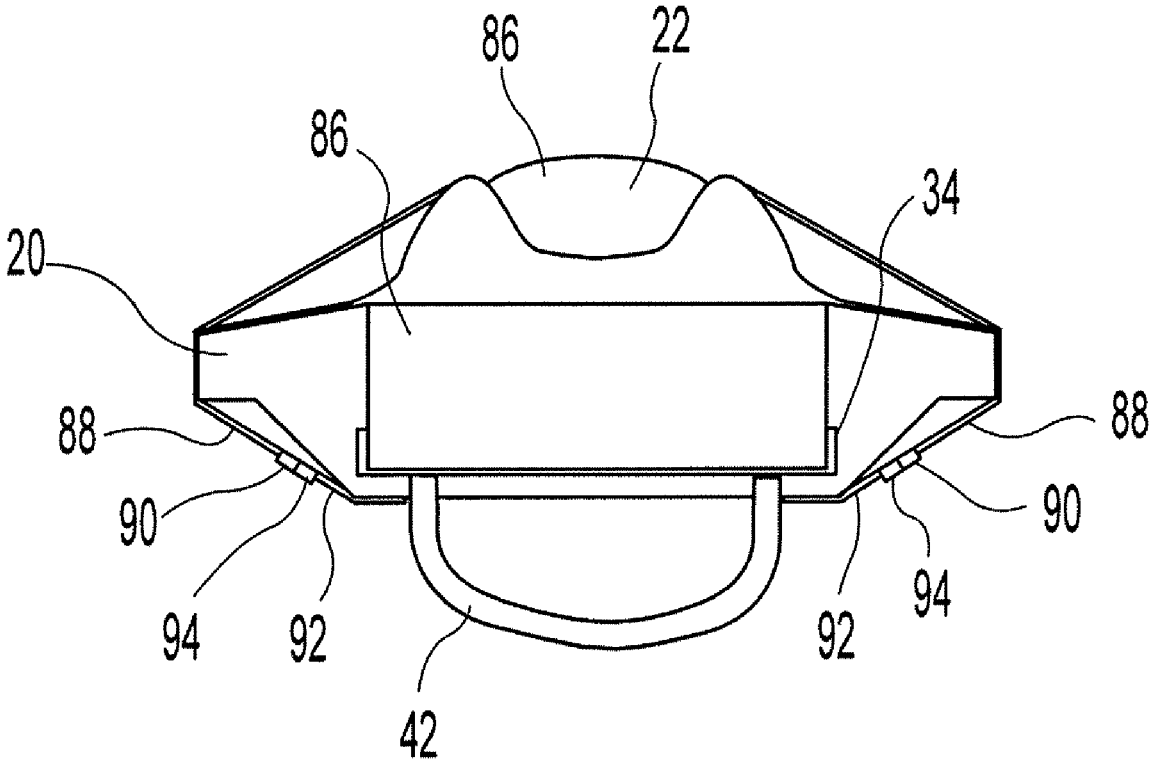
FIG. 4 is an end view of the mattress showing the patient restraint in a deployed position.

When deployed, as can be seen in FIGS. 3*a*, 3*b*, 3*c*, patient restraints 38, 40 overlay patient 22 and the outwardly extending arms of the "T" shaped wraps 86 are secured to mattress 20 to thereby secure patient 22 between wraps 86 and support surface 24 of mattress 20. Restraints 38, 40 each include securement members 88 in the form of flat nylon straps are affixed to wraps 86, e.g., by sewing a central portion of straps 88 to wraps 86. Straps 88 illustrated in FIGS. 3*a*, 3*b*, 3*c* also include disengageable latching mechanisms 90 at their ends for securing restraints 38, 40 to mattress 20. Alternatively, wraps 86 may include a sleeve through which straps 88 are inserted. Alternative embodiments may also provide an elastic section in straps 88 or attach latching mechanisms 90 directly to wraps 86 to provide a more elastically stretchable patient securement system.

FIG. 3*b* illustrates an articulatable mattress embodiment wherein the head section may be rotated upwardly to raise the head of the patient. In such embodiment, straps 88 and wraps 86 are configured to keep the patient secure during head section articulation.

In FIG. 3*c*, an embodiment including straps or handles 43, 45 at about the midsection of the mattress structure 20 is shown. Particularly in combination with the seat bucket or stiffeners 47 or plates (i.e., 72, 76, 78), such positioning of straps 43, 45 may reduce the need for additional carriers to transport a patient, for example, making it possible to accomplish patient transport with only two carriers, one carrier at each handle 43, 45.

A second nylon strapping member 92 is secured at the lower surface 26 of mattress 20 and includes latching members 94 that are releasably securable to latching mechanisms 90. A strap 92 with latching members 94 on each of its ends is provided for each of restraints 38, 40. In the illustrated embodiment straps 92 have a middle section, positioned below ticking 70, that is secured to substrate 50 through foam layer 46. Various other methods of securing straps 92 to mattress 20, however, may alternatively be employed. As can also be seen in FIGS. 3*a*, 3*b*, 3*c*, wrap 86 which is attached at the head end of mattress 20 has a cutout portion 87 through which the head of patient 22 may project.

Figure 8:
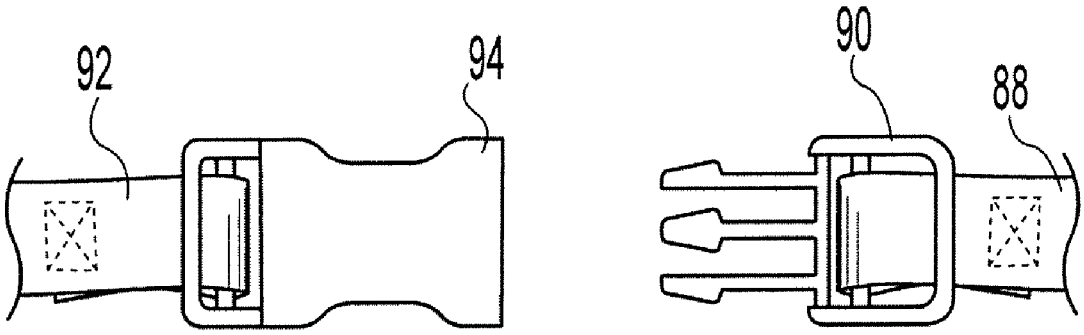
FIG. 8 is a side view of an adjustable strap for securing a patient.

Latching mechanisms 90, 94 are shown in FIG. 8 and are formed out of a suitably resilient polymeric material. Latching mechanisms 90, 94 are well known in the art and can be interchanged. Alternative forms of securing straps 88 relative to mattress structure 20 may also be employed.

Straps 88 may take the form of an adjustable strap that can be adjustably tightened about patient 22 after securing latching mechanisms 90, 94 together. For example, instead of being fixed with stitching as illustrated in FIG. 7, the end of strap 88 engaged with latching mechanism 90 could be threaded through mechanism 90 in a manner that allows the length of strap 88 to be adjusted at latching mechanism 90 by pulling on a loosely hanging free end of strap 88 in a manner commonly employed with latching mechanisms 90.

Figure 7:
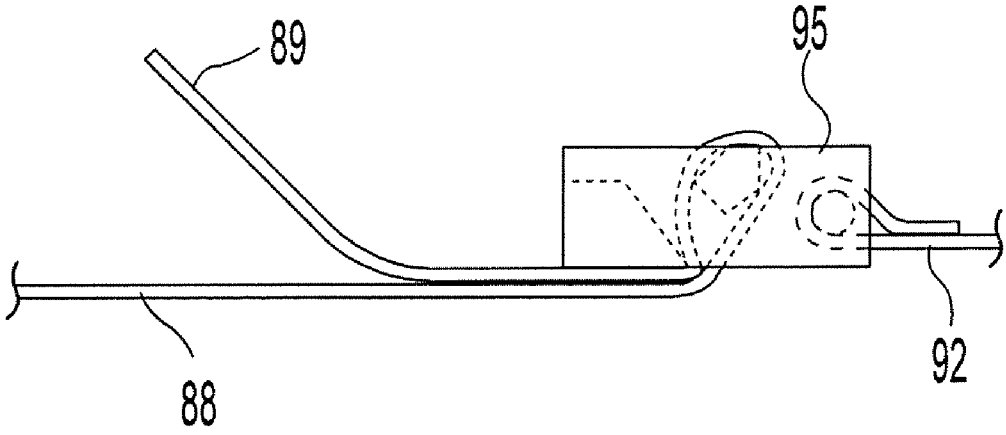
FIG. 7 is a view of latching mechanisms.

FIG. 7 illustrates an alternative method of securing the end of strap 88 to mattress 20 which allows for the tightening of strap 88 against patient 22. In this embodiment, strap 88 does not have a latching mechanism at its free end 89, instead free end 89 is threaded through a locking mechanism 95 located on the end of strap 92. Free end 89 is then pulled tight and locking mechanism 95 secures strap 88 in its tightened position. Locking mechanism 95 could also be placed in the center of strap 88 to provide adjustability while still employing latching mechanisms 90, 94 to secure the ends of strap 88 to strap 92.

When restraints 38, 40 are deployed for patient transport, for example in an evacuation event, a caregiver or other individual can grasp one of grip members 42, 44 and pull mattress 20, with patient 22 secured thereto, to thereby move the patient to another location.

Figure 9A:
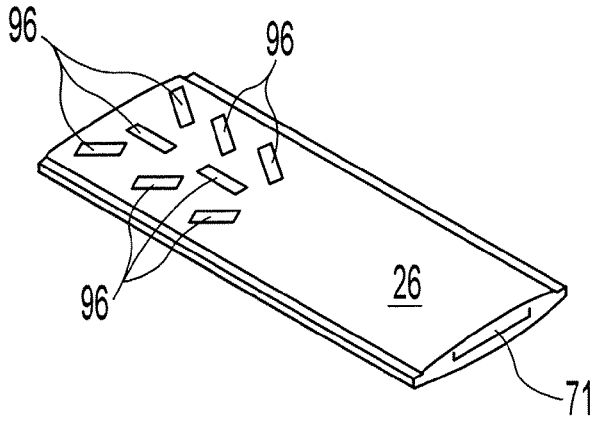
FIG. 9*a* is a bottom view of an embodiment having slide members.
Figure 9B:
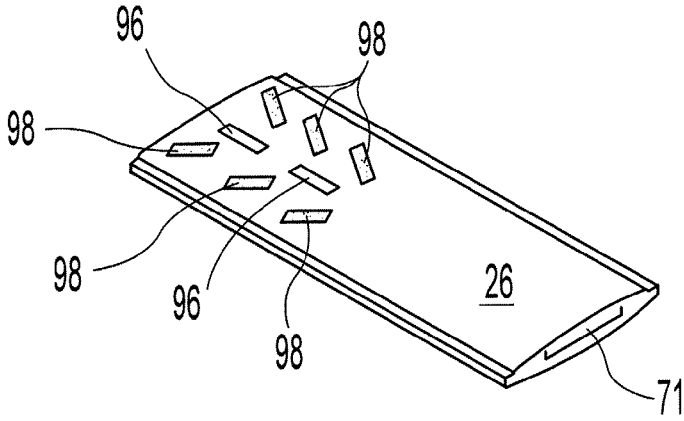
FIG. 9*b* is a bottom view of an embodiment including high friction slide members.
Figure 9C:
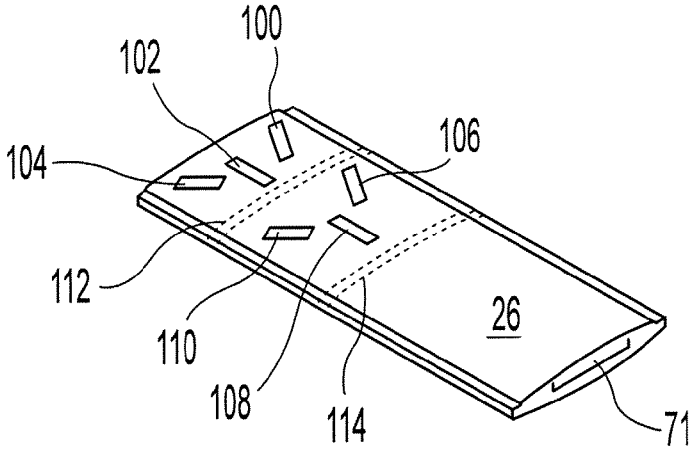
FIG. 9*c* is a bottom view of an embodiment having slide members and joints.

FIGS. 9*a*, 9*b*, 9*c* illustrates modified versions of mattress 20 which include one or more slide members 96 for facilitating the sliding of mattress 20, for example along a floor or other surface, down stairs, or into or out of an a transport vehicle. Slide members 96, 98 generally have dimensions that are less than the dimensions of the bottom side of the mattress. Slide members 96 include a low friction material. Slide members 96 may take the form of polymeric blocks attached to the lower surface 26 of mattress 20 which are formed out of a low friction material such as those used to form lubricant free bearing surfaces. These slide blocks may be secured to substrate 50 with countersunk fasteners and are positioned so that they are engageable with the floor surface when restraints 38, 40 are in their deployed positions. Alternatively, if restraints 38, 40 are configured to cover a significant portion of the lower surface 26 when in a deployed position, wraps 86 may have slides 96 disposed thereon.

As shown in FIG. 9*b*, slides 98 including a relatively high friction material, such as rubber, may also be provided in order to provide stability during movement or for other reasons. Such slides 96 could be formed out of a low friction tape material, e.g., Teflon® tape, applied in locations where the low-friction tape would engage the floor surface when restraints 38, 40 are deployed. Slides 96 and slides of relatively high friction material 98 may have varying degrees of stiffness or varying coefficients of friction, for example to facilitate transport of the mattress with a patient thereon and/or provide protection to a patient during transport. As shown in FIG. 9*b*, slides 96 and 98 may be arranged in various patterns for improved steering or handling of the mattress or for other reasons.

As shown in the embodiment of FIG. 9*c*, slides 100, 102, 104, 106, 108, 110 may be arranged to correspond with certain of the bendable sections 62 of the mattress, seen as joints 112 and 114 from the underside of the mattress. For example, a first pattern of slides 100, 102, 104 may be provided prior to or adjacent joint 112; and a second pattern of slides 106, 108, 110 may be provided between joints 112 and 114. Slides 100, 102, 104, 106, 108, 110 may be comprised of low and/or high friction material as noted above. Furthermore, the size and arrangement of the slides may be modified to improve steerability, slidability or handling of the mattress or for other reasons.

While this invention has been described as having an exemplary design, the present invention may be further modified within the spirit and scope of this disclosure. This application is therefore intended to cover any variations, uses, or adaptations of the invention using its general principles.

What is claimed is:

1. A mattress for use with a patient, the mattress comprising:

a mattress structure having a lower surface and a support surface spaced from and disposed opposite the lower surface to define an interior region, the support surface defining an outer perimeter;

a plurality of air bladders disposed in the interior region, the air bladders being configured to provide a number of support modes for a patient positioned on the support surface, at least one of the support modes being selectable by a caregiver;

at least one storage compartment defined by the mattress structure and disposed in the interior region adjacent the air bladders; and a patient restraint disposable within the at least one storage compartment when not in use and engageable with the patient and the mattress structure to secure the patient to the mattress structure when deployed.

2. The mattress of claim 1, further comprising a foam structure, the at least one storage compartment being at least partially defined by the foam structure.

3. The mattress of claim 1, further comprising:

at least one fluid filled bladder disposed within the mattress; and a pressure regulating apparatus operably coupled to the bladder.

4. The mattress of claim 1 further comprising at least two articulating longitudinal sections.

5. The mattress of claim 1, wherein the at least one storage compartment is disposed within a volume bounded by the lower surface, the support surface, and a set of planes intersecting the outer perimeter and oriented substantially transverse to the support surface.

6. The mattress of claim 5, wherein the at least one storage compartment comprises a first storage compartment at a head end of the mattress structure and a second storage compartment at a foot end of the mattress structure.

7. The mattress of claim 6, further comprising a second patient restraint and a second grip member, the patient restraint and grip member being disposable in the first storage compartment and the second patient restraint and second grip member being disposable in the second storage compartment.

8. The mattress of claim 1, further comprising a grip member affixed to the mattress structure, whereby the mattress structure can be grasped and used to move a patient secured thereto.

9. The mattress of claim 8, wherein the patient restraint is affixed to the mattress structure, the patient restraint and the grip member each being disposable in the at least one storage compartment.

10. The mattress of claim 1, further comprising at least one seat stiffener situated near the longitudinal midpoint of the mattress structure.

11. The mattress of claim 10, further comprising at least one grip member affixed to the mattress structure adjacent to the at least one seat stiffener.

12. The mattress of claim 1, wherein the patient restraint includes a first member securable to a second member, the second member being affixed to the lower surface of the mattress structure.

13. The mattress of claim 1, further comprising at least one slide member engageable with a floor when the patient restraint is deployed to facilitate sliding of the mattress structure.

14. The mattress of claim 13, wherein at least one slide member is comprised of a material with a low coefficient of friction, and at least one slide member is comprised of a material with a high coefficient of friction.

15. The mattress of claim 14, wherein at least one slide member comprised of a material with a high coefficient of friction is placed nearer the outer perimeter of the support surface than the at least one slide member comprised of a material with a low coefficient of friction.

16. The mattress of claim 15, wherein the patient restraint comprises a fabric wrap, the patient being securable between the fabric wrap and the support surface.

17. The mattress of claim 16, wherein the fabric wrap comprises a disengageable latching mechanism for securing the fabric wrap in a deployed position wherein the patient is secured between the fabric wrap and the support surface.

18. The mattress of claim 17, wherein the disengageable latching mechanism is disengageably securable to a second latching mechanism affixed to the lower surface of the mattress structure.

19. The mattress of claim 16, wherein the fabric wrap further comprises an adjustable strap which is tightenable to secure the patient to the mattress structure.

20. A mattress for use with a person, the mattress comprising:

a mattress structure having a lower surface and a support surface disposed opposite the lower surface, the support surface adapted to support a person, the support surface having a head end and a foot end spaced apart from the head end, the mattress structure including a foam member and a plurality of fluid filled bladders, the mattress structure defining a first volume bounded by the lower surface, the support surface and the head and foot ends, the foam member and the fluid filled bladders being located in the first volume, at least one of the fluid filled bladders being selectively inflatable to turn a patient supported by the support surface;

at least one storage compartment disposed within the first volume;

at least one patient restraint affixed to the mattress structure and disposable in the at least one storage compartment when not in use and engageable with the patient and the mattress to secure the patient to the mattress when deployed; and a grip member affixed to the mattress, the grip member being graspable by an individual when relocating the mattress with the patient secured thereto by the patient restraint.

21. The mattress of claim 20, further comprising a cover defining an interior region, wherein the mattress structure is located in the interior region.

22. The mattress of claim 21, comprising a handle coupled to the cover.

23. The mattress of claim 21, wherein the mattress structure includes at least one air bladder adaptable to be used as a flotation device.

24. The mattress of claim 21, wherein the mattress structure includes a bendable section disposed at a location to facilitate transport.

25. The mattress of claim 24, further comprising a slide member coupled to the bendable section.

* * * * *